US006299728B1

(12) United States Patent
Kurtz et al.

(10) Patent No.: US 6,299,728 B1
(45) Date of Patent: Oct. 9, 2001

(54) MULTI-PLY PAPER

(75) Inventors: Rüdiger Kurtz, Heidenheim; Kurt Hack, Ravensburg, both of (DE)

(73) Assignee: Voith Sulzer Papiermaschinen GmbH, Heidenheim (DE)

( * ) Notice: Subject to any disclaimer, the term of this patent is extended or adjusted under 35 U.S.C. 154(b) by 0 days.

(21) Appl. No.: 09/015,588

(22) Filed: Jan. 29, 1998

(30) Foreign Application Priority Data

Jan. 31, 1997 (DE) ..... 197 03 466

(51) Int. Cl.[7] ..... D21F 11/00

(52) U.S. Cl. ..... 162/126; 162/129; 162/130; 162/135; 162/136; 162/137; 162/147; 162/265

(58) Field of Search ..... 162/126, 129, 162/135, 130, 136, 137, 147

(56) References Cited

U.S. PATENT DOCUMENTS

| | | | | |
|---|---|---|---|---|
| 1,685,917 | * | 10/1928 | Hans | 162/126 |
| 2,229,620 | * | 1/1941 | Bredner | 162/135 |
| 4,153,303 | * | 5/1979 | Booth et al. | 162/129 |
| 5,032,225 | * | 7/1991 | Saji et al. | 162/135 |
| 5,039,378 | * | 8/1991 | Pommier et al. | 162/130 |
| 5,536,535 | * | 7/1996 | Yamazaki et al. | 162/136 |
| 5,753,078 | * | 5/1998 | Koutitonsky et al. | 162/135 |
| 5,789,031 | * | 8/1998 | Hirabayashi et al. | 162/136 |
| 5,800,870 | * | 9/1998 | Lyebke et al. | 162/136 |

FOREIGN PATENT DOCUMENTS

| | | | | |
|---|---|---|---|---|
| 43 05 134 | | 3/1995 | (DE) . | |
| 44 11 987 | | 10/1995 | (DE) . | |
| 41 18 340 | | 7/1996 | (DE) . | |
| 0 417 368 A1 | | 3/1991 | (EP) . | |
| 0 651 092 | | 5/1995 | (EP) . | |
| 2641011 | | 6/1990 | (FR) . | |
| 876037 | * | 8/1961 | (GB) | 162/126 |
| 4-333700 | | 11/1992 | (JP) . | |
| 5-93392 | | 4/1993 | (JP) . | |
| 6-33396 | | 2/1994 | (JP) . | |
| WO 88/03871 | | 6/1988 | (WO) . | |
| WO96/28609 | * | 9/1996 | (WO) . | |

* cited by examiner

*Primary Examiner*—James Derrington
(74) *Attorney, Agent, or Firm*—Taylor & Aust, P.C.

(57) ABSTRACT

A multi-ply paper includes a fiber material base layer, which is unbleached or made of wastepaper, and a top layer. Instead of a conventional "white" fiber material top layer, the top layer is in the form of a white or colored top coating.

7 Claims, 2 Drawing Sheets

MULTI-PLY PAPER

BACKGROUND OF THE INVENTION

1. Field of the Invention

The present invention relates to a multi-ply paper as well as to a method and an apparatus for the manufacture of such multi-ply paper.

2. Description of the Related Art

In the manufacture of paper with specific application profiles, notably packing papers, attempts are presently being made at producing papers which in their Z-axis (perpendicular to the surface of the vertical axis) depend heavily on depth as regards their fiber and solids concentration. For ones attempts are directed at embedding, with the aid of multilayer headboxes, low-cost materials (wastepaper basis) in the middle ply of the paper and applying the high-quality, or expensive materials only on the outer plies or one outer ply where they substantially determine the quality of the paper, e.g., to make them suited for printing.

Reference is made to European Patent Document No. EP 0 651 092 A1. This document teaches a multilayer headbox and a method for the manufacture of a multi-ply paper with which it is possible to specifically enrich the stock suspension of the outer layers with the desired materials. Thereby, the desired profile of the concentration across the Z-axis is maximally approached, so as to obtain a maximally white surface of good printability on the paper top side. The desired profile has a low concentration in the center and a high concentration at the edges, also known as a "smiley profile."

In another method, several headboxes (secondary headboxes) successively apply individual paper layers with different properties on one or several fourdrinier wires, thus creating a multi-ply paper. The multi-ply paper includes a high-quality, mostly bleached and printable chemical wood pulp layer (e.g., "white top liner") on at least one side.

Problems associated with all of the above methods are that very much dewatering energy is necessary in forming the plies and that the machinery expense for the manufacture is considerable. The biggest problem, however, is that all of the above methods are based on the use of expensive bleached chemical wood pulp or deinked fiber stock as raw material.

A further problem is that there are many paper machines in operation which no longer satisfy today's needs with respect to the quality of the papers they produce.

SUMMARY OF THE INVENTION

The present invention creates a paper product which is easier and less expensive to produce and which offers a better surface with respect to its printability.

The present invention also provides a method and apparatus which enable a reduction of the dewatering energy and require only low machinery expense.

According to the invention, a paper is proposed which as a top layer (cover layer) contains no paper layer of expensive raw materials, but rather contains only a top coating.

The inventors have recognized that existing paper machines for single-ply papers can easily be retrofitted to a two-ply product (single paper layer and top coating) with the inventional solution, and that, surprisingly, the above desired properties are obtained.

The invention proposes a method for the manufacture of paper or cardboard with at least one top layer, notably white, containing no paper fibers, wherein a fiber material layer is produced with a headbox and a following former or fourdrinier wire. The fiber material layer is dried with at least one press section and a following dryer section. The wet section and/or dryer section may be equipped with a sizing or film press or other coater. At least one coating is applied with the aid of a coater or film press, the coating giving the paper a top layer with particular properties, e.g., sound printability, or a special appearance (e.g., mottled).

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
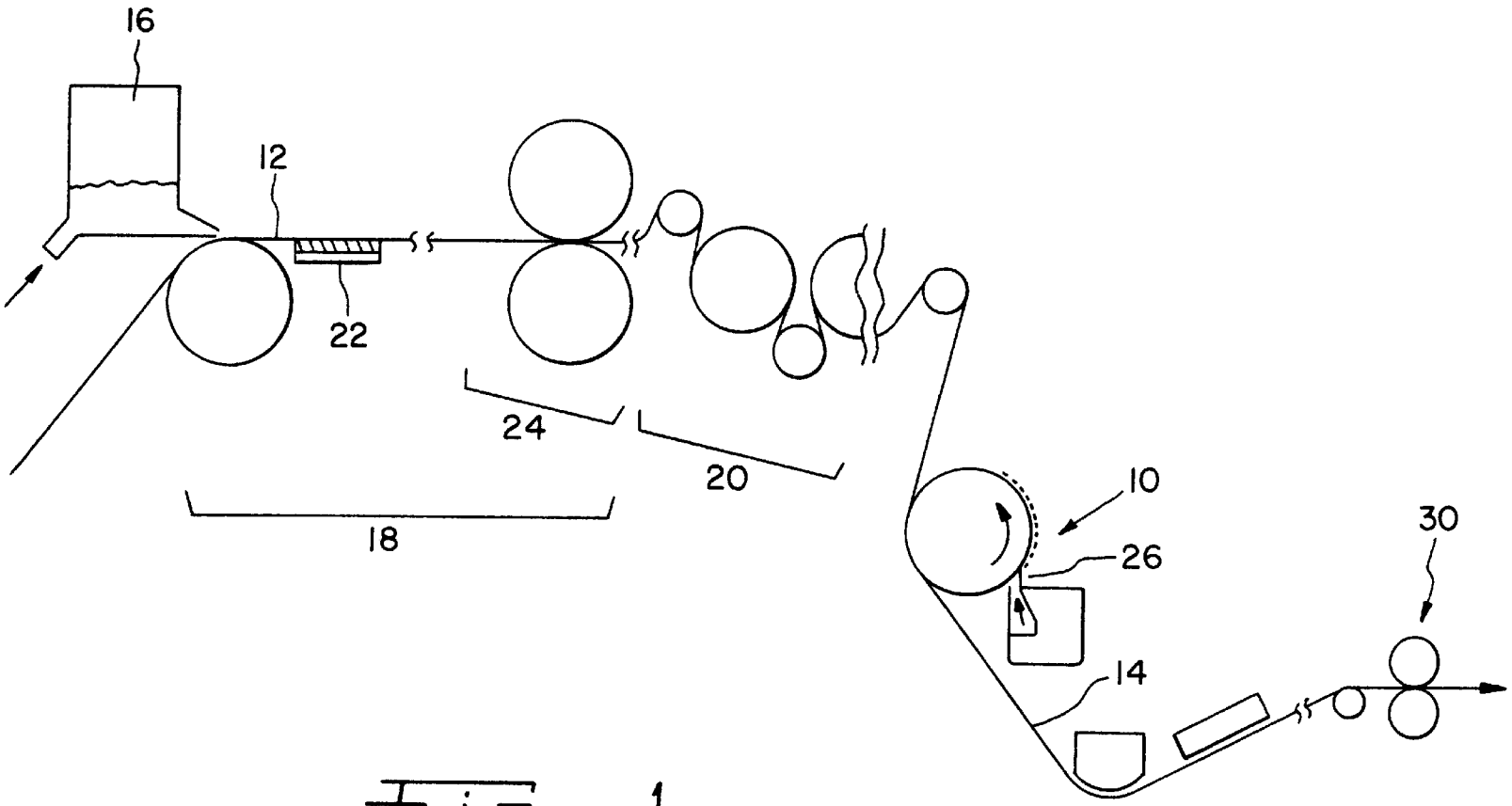
FIG. 1 is a schematic, side, sectional view of an embodiment of a paper-making machine of the present invention.
Figure 2:
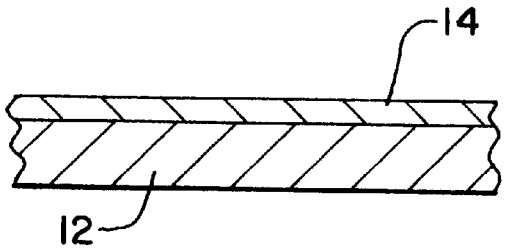
FIG. 2 is a fragmentary, cross-sectional view of an embodiment of a multi-ply paper of the present invention.

Referring now to the drawings, and more particularly to FIG. 1, there is shown at least one coater or applicator 10 which provides a traveling paper or cardboard web 12 (FIG. 2) with a top coating 14 instead of the previous, more expensive "white" fiber material layer (paper layer). Coater 10 may be installed substantially anywhere between a headbox 16 and a winder (not shown) of an existing paper machine for the manufacture of paper or cardboard webs without modification of the machine concept, i.e., of the existing paper machine. For example, applicator 10 can be arranged within a paper machine in a wet section 18, in a dryer section 20, and/or other sections of the paper machine.

In the method of the present invention, fiber material layer 12 is produced with headbox 16 and a following former 22 or fourdrinier wire. Web 12 is dried with at least one press section 24 and the following dryer section 20. Top coating 14 may be applied as a single or multiple coating with or without intermediate drying. Additionally, the method may be carried out on-line or off-line. An overall coating weight of 1 to 25 g/m$^2$ is possible.

The fiber material layer, which inventionally contains no expensive bleached raw materials, allows superb top coating. The top coating (single or multiple coating) may include color only, with the color, in turn, including additives, pigments and binders suspended in liquid (such as water). The top coating may also contain fiber material in addition to color.

Figure 3:
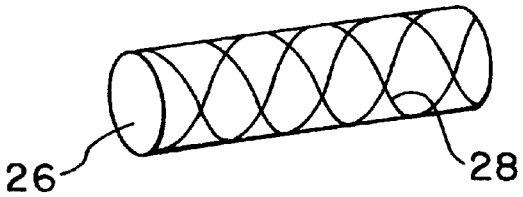
FIG. 3 is a fragmentary, perspective view of the doctor element of FIG. 1.
Figure 4:
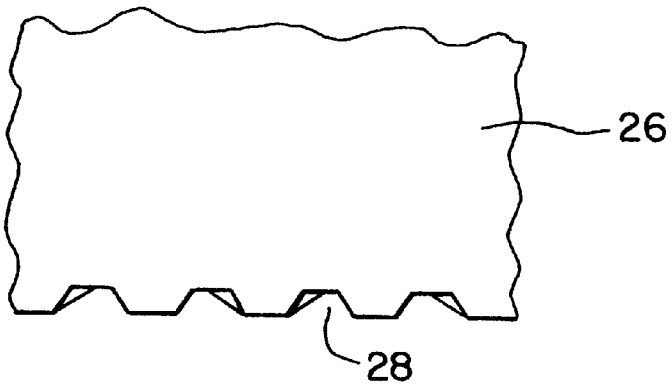
FIG. 4 is a fragmentary, front view of the doctor element of FIG. 3.

If desired, the properties (solids content, amount of coating, composition, viscosity, pigment size, etc.) of the top coating may be adjusted in keeping with the selected applicator such that, e.g., a homogenous, inhomogeneous, striated, flamelike or mottled impression is created. Such appearance, of course, may also be created with a doctor element such as a doctor rod 26 (FIG. 3) as a coating organ which features a specifically defined surface pattern 28 (FIG. 4).

The top-coated paper may then be additionally smoothed in a customary manner in smoothing apparatuses with a hard nip, hard hot nip, soft nip, hot soft nip, so-called deep nip, or any combination thereof. A single-nip smoothing device 30 (FIG. 1) is shown positioned after coater 10.

Particular advantages of the inventional method and apparatus are:

Reduced energy demand in dewatering and drying, due to not having to dewater the top layer.

Material cost reduction, since the applied coating medium is less expensive than fiber material.

Lower machinery expense for the manufacture of the paper, since a simple headbox with a following coater (e.g., blade coater, speed coater, speed sizer, short dwell time coater, open-jet nozzle applicator) are sufficient for direct or indirect coating.

The manufactured product is characterized by increased ply strength (ply bond strength), since the couching necessary with a multi-ply paper is dispensable here.

Very good optical properties and printability can be imparted very easily to the product with the aid of the coating medium.

The optical density of the top layer is greater than that of a white fiber material layer and allows a more homogeneous application.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of manufacturing a multi-ply paper, said method comprising the sequential steps of:

producing a single fiber material layer consisting essentially of wastepaper with a headbox and one of a former and a fourdrinier wire, said one of a former and a fourdrinier wire being disposed after said headbox relative to a direction of travel of said fiber material layer;

drying the fiber material layer with at least one press section and a dryer section, said dryer section being disposed after said at least one press section relative to the direction of travel of the fiber material layer;

providing a non-bleached top coating directly on said fiber material layer with at least one coater, said top coating being a non-fibrous coating consisting essentially of one of whitening and color, whereby said top coating replaces one fiber material layer of said multi-ply paper; and smoothing said top-coated fiber material layer using a single-nip smoothing device having a hard nip.

2. The method of claim 1, wherein said non-fibrous top coating is a color coating, said color consisting essentially of additives, pigments and binders suspended in a liquid.

3. The method of claim 2, wherein said liquid comprises water.

4. The method of claim 1, wherein said top coating comprises a plurality of coats.

5. The method of claim 4, comprising the further step of drying said top coating between said plurality of coats.

6. The method of claim 1, wherein said top coating has a coating weight of approximately between 1 and 25 $g/m^2$.

7. A method of manufacturing a multi-ply paper, said method comprising the sequential steps of:

producing a single fiber material layer consisting essentially of wastepaper and unbleached fibers with a headbox and one of a former and a fourdrinier wire, said one of a former and a fourdrinier wire being disposed after said headbox relative to a direction of travel of said fiber material layer;

drying the fiber material layer with at least one press section and a dryer section, said dryer section being disposed after said at least one press section relative to the direction of travel of the fiber material layer;

providing a non-bleached top coating directly on said fiber material layer with at least one coater, said top coating being a non-fibrous coating consisting essentially of one of whitening and color, whereby said top coating replaces one fiber material layer of said multi-ply paper; and smoothing said top-coated fiber material layer using a single-nip smoothing device having a hard nip.

* * * * *